US007527446B2

(12) United States Patent
Johnson Papa et al.

(10) Patent No.: US 7,527,446 B2
(45) Date of Patent: May 5, 2009

(54) CHILDREN'S COMBINATION TOOTHBRUSH AND TOOTHPASTE DISPENSER, AND METHOD

(75) Inventors: Alyce Johnson Papa, Wyoming, OH (US); Jeffrey James Stechschulte, Cincinnati, OH (US); Philip Andrew Sawin, Hamilton, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 529 days.

(21) Appl. No.: 11/142,122

(22) Filed: Jun. 1, 2005

(65) Prior Publication Data

US 2006/0245814 A1 Nov. 2, 2006

Related U.S. Application Data

(63) Continuation-in-part of application No. 11/118,958, filed on Apr. 29, 2005, now abandoned.

(51) Int. Cl.
*A46B 11/00* (2006.01)

(52) U.S. Cl. ..... 401/125; 401/123

(58) Field of Classification Search ..... 401/123, 401/118, 129, 195, 125; 222/96, 106, 102, 222/101, 78; 141/360, 362, 364, 110, 198; 15/167.1

See application file for complete search history.

(56) References Cited

U.S. PATENT DOCUMENTS 1,051,815 A * 1/1913 Morgan ..... 15/143.1
3,885,707 A * 5/1975 Wittwer ..... 222/96
4,403,714 A 9/1983 Kane
4,424,916 A * 1/1984 Pearson ..... 222/105
4,640,442 A * 2/1987 Drobish ..... 401/176
4,671,432 A * 6/1987 Benecke et al. ..... 222/386
4,955,567 A * 9/1990 Longhurst ..... 222/156
5,050,773 A 9/1991 Choi
5,158,383 A 10/1992 Glover et al.
5,209,376 A 5/1993 Dirksing
5,305,922 A 4/1994 Varon
5,353,464 A * 10/1994 Atkins et al. ..... 15/167.1
5,444,889 A * 8/1995 Barre ..... 15/167.1
5,482,187 A * 1/1996 Poulsen et al. ..... 222/78

(Continued)

FOREIGN PATENT DOCUMENTS

DE 29918511 U1 3/2000

(Continued)

OTHER PUBLICATIONS

U.S. Appl. No. 11/128,569, filed May 13, 2005, Johnson Papa et al.

(Continued)

*Primary Examiner*—David J Walczak
(74) *Attorney, Agent, or Firm*—Thibault Fayette Sarah Ann Dressel

(57) ABSTRACT

A combination toothbrush and toothpaste dispenser, and method, are adapted for use by a child. The dispenser provides an easily actuatable activator that, when operated, discharges a predetermined amount of toothpaste from an orifice. The toothbrush is adapted to automatically lift the toothbrush head off of a support surface to a height near that of the dispenser orifice. As a result, a child may focus on manipulating one item at a time when loading a toothbrush with toothpaste.

13 Claims, 12 Drawing Sheets

U.S. PATENT DOCUMENTS

| | | | | |
|---|---|---|---|---|
| 5,810,205 | A | 9/1998 | Kohen | |
| 5,845,813 | A | 12/1998 | Werner | |
| 5,897,030 | A | 4/1999 | Stangle | |
| 5,956,796 | A | 9/1999 | Lodato et al. | |
| 6,345,731 | B2 | 2/2002 | Bitton | |
| 6,454,133 | B1 | 9/2002 | Lopez et al. | |
| 6,474,509 | B1 | 11/2002 | Prince et al. | |
| 6,698,065 | B2 * | 3/2004 | Lauer | 401/268 |
| 6,715,521 | B2 | 4/2004 | Back | |
| 6,789,703 | B2 | 9/2004 | Pierre-Louis | |
| 6,834,780 | B2 | 12/2004 | Levy | |
| 6,880,726 | B1 * | 4/2005 | Perez | 222/102 |
| 2003/0164383 | A1 | 9/2003 | Pierre-Louis | |
| 2007/0039109 | A1 * | 2/2007 | Nanda | 15/167.1 |

FOREIGN PATENT DOCUMENTS

| | | | |
|---|---|---|---|
| EP | 0 457 452 | A2 | 11/1991 |
| WO | WO97/05043 | | 2/1997 |

OTHER PUBLICATIONS

PCT International Search Report—Aug 22, 2006.

* cited by examiner 50
56
58
60
62
82
84
78
54
76
86
52
80
70
72
74
40
64

110
115

110
115
114
113
112
112
114
113

110
115
113
32
20
112

CHILDREN'S COMBINATION TOOTHBRUSH AND TOOTHPASTE DISPENSER, AND METHOD

CROSS REFERENCE TO RELATED APPLICATIONS

This application is a continuation-in-part of U.S. application Ser. No. 11/118,958, filed on Apr. 29, 2005 now abandoned.

FIELD OF THE DISCLOSURE

The present disclosure generally relates to oral hygiene products and methods and, more particularly, to such products and method adapted for children.

BACKGROUND OF THE DISCLOSURE

The teaching and motivation of toddlers and young children is a subject of much attention in patent and general literature. In particular, numerous writings, devices, techniques, aides, and kits have been proposed to assist children, parents (or other caregivers), or both, with learning and performing oral hygiene tasks. A common challenge for a caregiver is to teach the child to perform a complete oral hygiene task, particularly where the task requires several steps. At the outset, a caregiver will often provide at least some assistance and instruction on how to complete the task. The ultimate goal, however, is for the child to be able to execute the oral hygiene task unassisted. The age at which a child will practice an oral hygiene task on his or her own is dependent upon many factors, some of which are psychological, some physiological, and some unique to each individual child.

Conventional oral hygiene products and methods are overly difficult for a child to use or perform. When performing tooth brushing, for example, current products typically require a child to simultaneously manipulate two separate items at some point in the process. When loading a brush with toothpaste, for example, the child must hold the toothbrush in one hand while dispensing toothpaste from a container with the other hand. Unfortunately, many children are unable to properly or efficiently perform this task, since they are at a stage of physiological development where muscle control and general coordination are limited. Consequently, oral hygiene apparatus and methods are needed that facilitate successful use by children.

DETAILED DESCRIPTION

Combinations of a toothbrush and a toothpaste dispenser, as well as methods for using such combinations, are disclosed that are particularly adapted for use by a child. Specifically, the combinations and methods allow a child to apply toothpaste to a toothbrush using a single hand.

As used herein, the term "comprising" means that the various components, ingredients, or steps, can be conjointly employed in practicing the present invention. Accordingly, the term "comprising" is open-ended and encompasses the more restrictive terms "consisting essentially of" and "consisting of." Other terms may be defined as they are discussed in greater detail herein.

As used herein a "caregiver" means a person other than the child, such as, a parent, babysitter, family member, teacher, day care worker, or other person who is able to provide sufficient assistance to the child to complete a personal hygiene task. For purpose of style and simplicity, the term "parent" will be used in this specification to refer generally to any caregiver and the use of this term is in no way intended to limit the scope of the aides described and claimed.

As used herein, a "compressing mechanism" includes any known manner of extracting toothpaste from a toothpaste container. Such compressing mechanisms may be manually or electrically operated. Known pump type compressing mechanisms include those disclosed in U.S. Pat. No. 6,345,731 to Bitton; U.S. Pat. No. 6,834,780 to Levy; U.S. Pat. No. 5,305,922 to Varon; U.S. Pat. No. 6,715,521 to Back, each of which is incorporated by reference herein. Known squeeze-type compressing mechanisms include those disclosed in U.S. Pat. No. 5,845,813 to Werner; U.S. Pat. No. 6,789,703 to Pierre-Louis; U.S. Pat. No. 6,474,509 to Prince et al.; U.S. Pat. No. 6,454,133 to Lopez et al; U.S. Pat. No. 5,810,205 to Kohen; and U.S. Pat. No. 5,897,030 to Stangle, each of which is incorporated herein by reference. Known types of electrically operated compressing mechanisms include those disclosed in U.S. Pat. No. 5,050,773 to Choi and U.S. Pat. No. 4,403,714, both of which are incorporated by reference herein.

Figure 1:
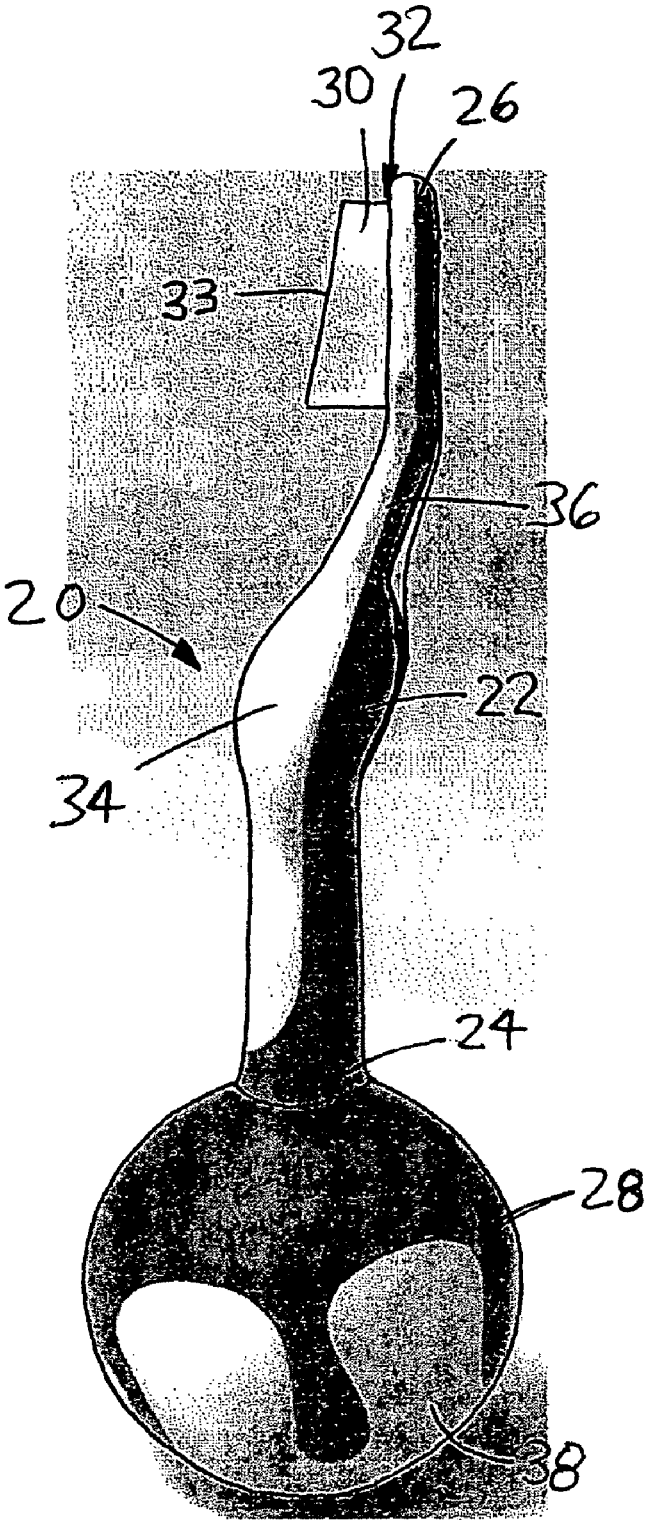
FIG. 1 is a perspective view of a toothbrush adapted for use by children.

FIG. 1 illustrates a toothbrush 20 adapted for use by a child. The toothbrush 20 includes a handle 22 having a proximal end 24 and a distal end 26. An enlarged base 28 is coupled to the proximal end 24. Tooth cleaning structure, such as bristles 30, are coupled to the distal end 26 to form a brush head 32. The brush head 32 defines a toothpaste receiving surface 33, which in the illustrated embodiment is oriented at an angle with respect to the proximal end of the handle 22.

In the illustrated embodiment, the handle 22 is contoured so that it may be comfortably gripped by a child. Accordingly, the handle 22 includes an enlarged section 34 and an angled portion 36 leading to the brush head 32. In addition, the handle 22 and base 28 may carry graphics, icons, or other images to attract a child's attention. In the illustrated embodiment, the base 28 includes an image of a frog's hand 38.

Figure 4:
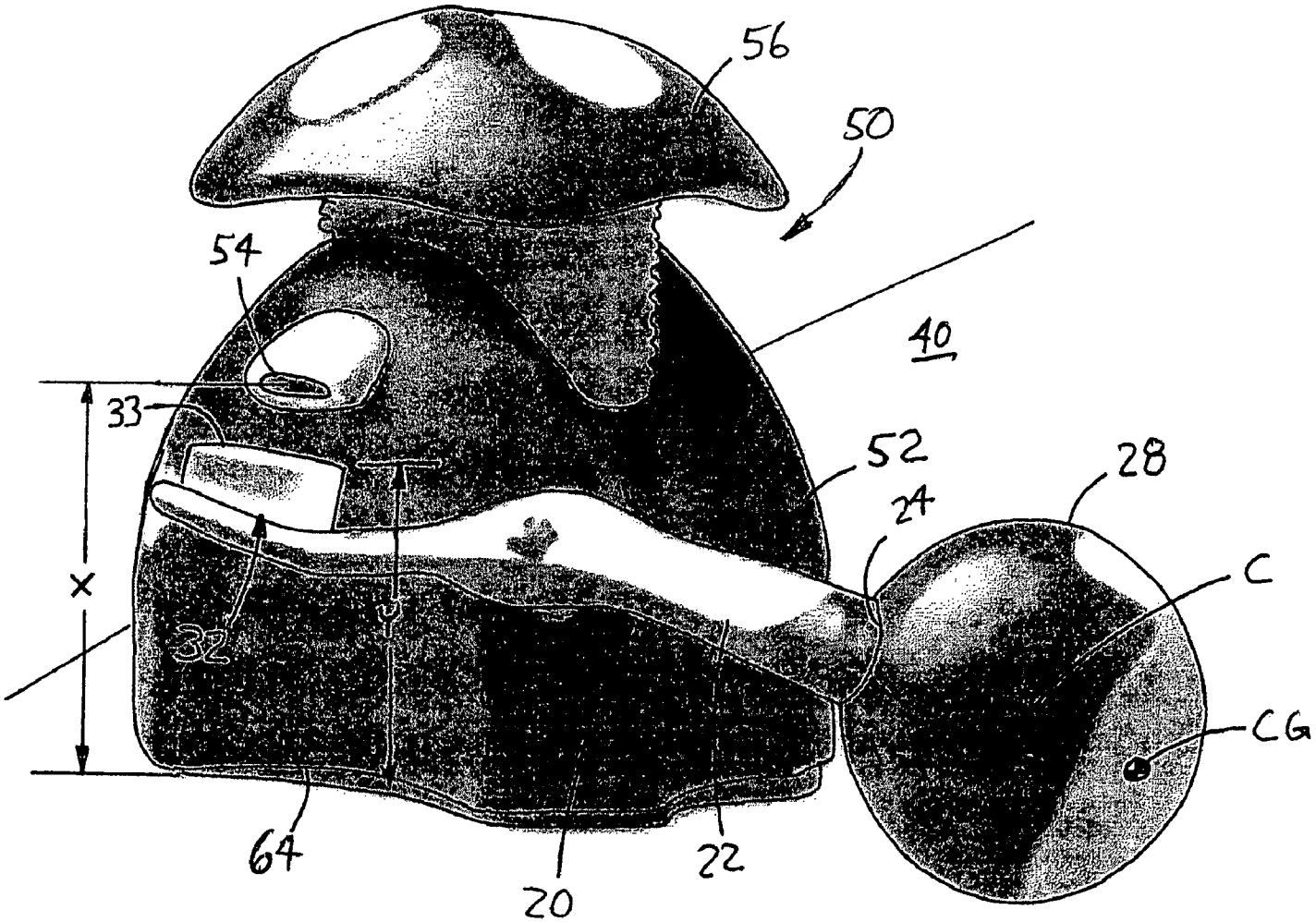
FIG. 4 is a side elevation view of the toothbrush of FIG. 1 positioned to receive toothpaste from the toothpaste dispenser of FIG. 2.

The base 28 may be shaped and or eccentrically weighted to maintain the toothbrush 20 in an angular orientation illustrated in FIG. 4. In the illustrated embodiment, the base 28 is formed substantially as a sphere. The sphere, by using internal voids, weights, or other means for introducing non-uniform mass, has a center of gravity CG that is spaced from a geometric center C of the sphere. In the illustrated embodiment, the center of gravity CG is spaced farther away from the handle proximal end 24 than the geometric center C. The sphere further has a mass sufficiently greater than the handle 22 and brush head 32, so that the eccentrically located center of gravity CG forces the toothbrush to rotate about an exterior of the sphere to an equilibrium state, in which the handle 22 extends from the base 28 at an angle with respect to a plane defined by a support surface 40 on which the toothbrush 20 rests. In this position, the brush head 32 is held above the support surface 40. The center of gravity CG is preferably located such that the toothbrush receiving surface 33 is automatically oriented generally towards the orifice 54. The center of gravity CG may further be located, and or the outer surface of the enlarged base 28 may be appropriately shaped, such that the toothbrush 22 has a second equilibrium position, like the substantially vertical orientation illustrated in FIG. 1.

Figure 2:
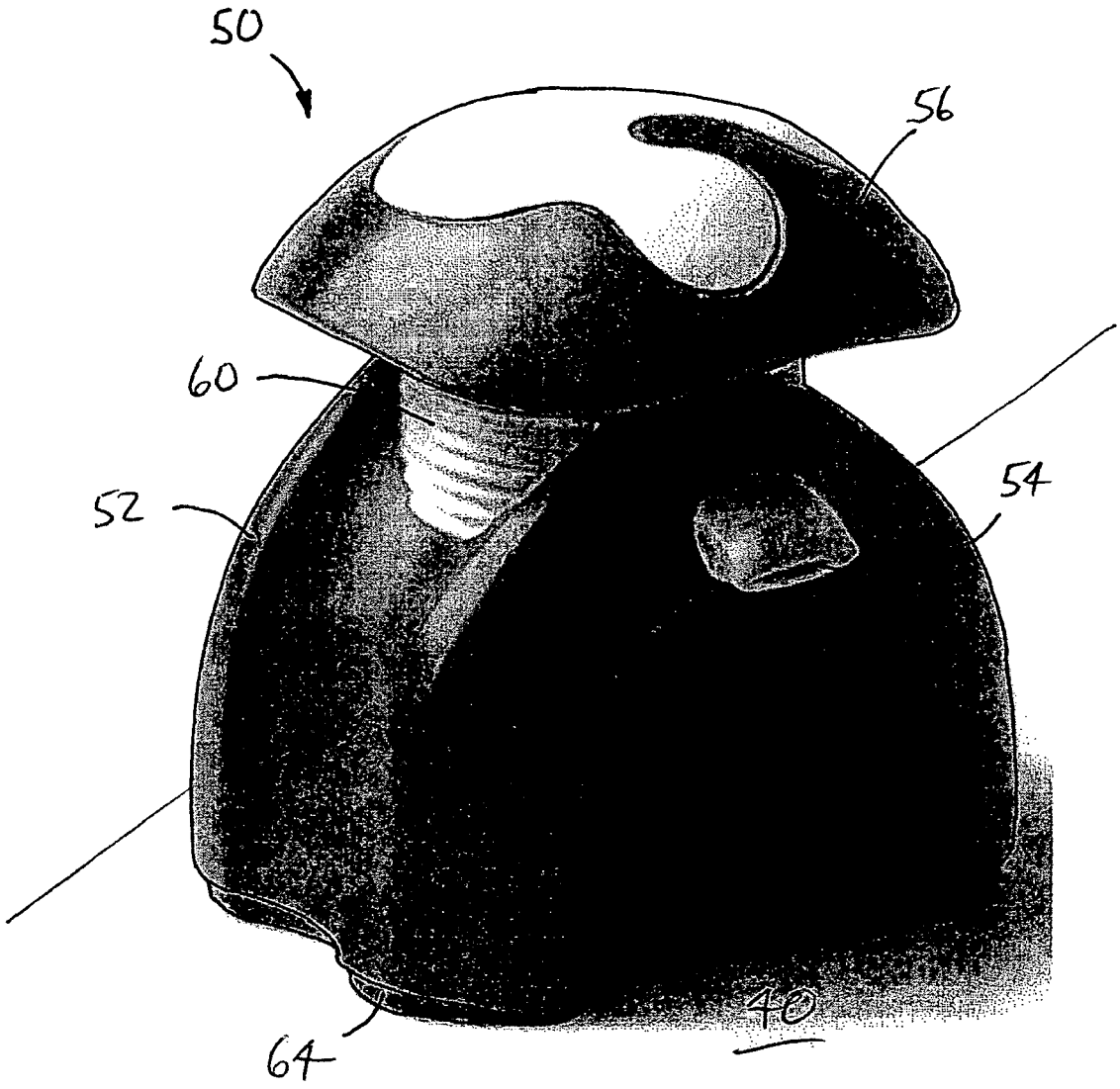
FIG. 2 is a perspective view of a toothpaste dispenser adapted for use by children.
Figure 3:
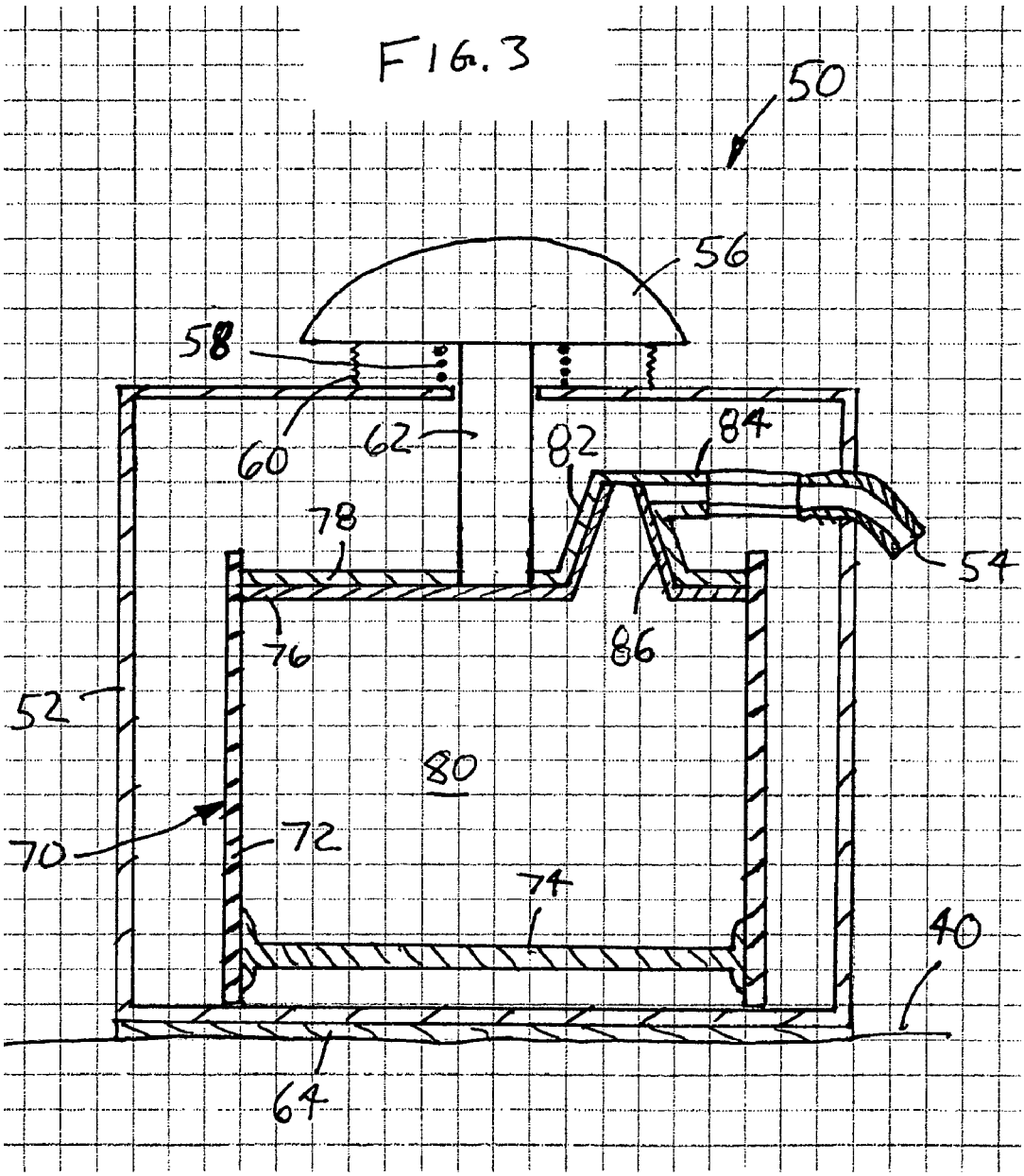
FIG. 3 is a side elevation view, in cross-section, of the toothpaste dispenser of FIG. 2.

FIGS. 2 and 3 illustrate a toothpaste dispenser 50 adapted for use by a child. The dispenser 50 includes a housing 52 and a discharge orifice 54 extending therethrough. An activator 56 is positioned at a top of the housing 52 and is supported for reciprocating vertical motion between normal and actuated positions. A biasing element, such as spring 58, extends between the housing 52 and a bottom of the activator 56 to apply a vertically upwardly directed biasing force to the activator 56. A user may engage a top of the activator and apply a downward actuation force to overcome the bias force. A shroud 60 surrounds the spring 58 and extends between the housing 52 and the activator 56 to provide an attractive appearance. As best shown in FIG. 3, a stem 62 is coupled to the activator 56 and extends into an interior of the housing 52. The container 52 preferably includes a slip resistant base 64 to prevent movement of the dispenser along the support surface 40 during use.

In the embodiment illustrated at FIG. 3, a toothpaste cartridge 70 is received within the dispenser housing 52. Toothpaste cartridge 70 and dispenser housing 52 may be adapted to provide lock-and-key functionality such that only certain toothpaste cartridges will work with certain dispenser housings. The incorporation of lock-and-key functionality may utilize a variety of technologies including, but not limited to, mechanical and/or electrical means. The cartridge 70 is similar to the cartridge construction disclosed in U.S. Pat. No. 5,158383, which issued to Glover et al. on Oct. 27, 1992, the entirety of which is incorporated by reference herein. Accordingly, the cartridge 70 includes a sidewall 72, a sliding lower piston 74, a sliding upper piston 76, and a fixed upper wall 78. The lower and upper pistons 74, 76 sealingly engage an interior surface of the sidewall 72 to define an interior reservoir 80 for holding toothpaste. The lower piston 74 is adapted to move only in the upward direction, as is known in the art. The upper piston 76 may be releasably connected to the stem 62, such as by mating threads, and is adapted to slide along the interior surface of the sidewall 72. Accordingly, the upper piston 76 will move when an actuating force is applied or removed from the activator 56. The fixed upper wall 78 includes a frustoconical portion 82 defining a spout 84. The upper piston 76 includes a portion 86 that nests within the upper wall frustoconical portion 82 and extends across the spout opening to close the spout. The spout 84 fluidly communicates with the discharge orifice 54.

The activator 56 has a normal position which prevents toothpaste from passing through the orifice 54, as best shown in FIG. 3. In this position, the upper piston 76 is forced upward by the spring 58 (via the activator 56 and stem 62) so that it engages the fixed upper wall 78. The portion 86 of the upper piston 76 is fully inserted into the frustoconical portion 82 of the upper wall 78 thereby to close off the spout and prevent toothpaste from flowing to the orifice.

Figure 5:
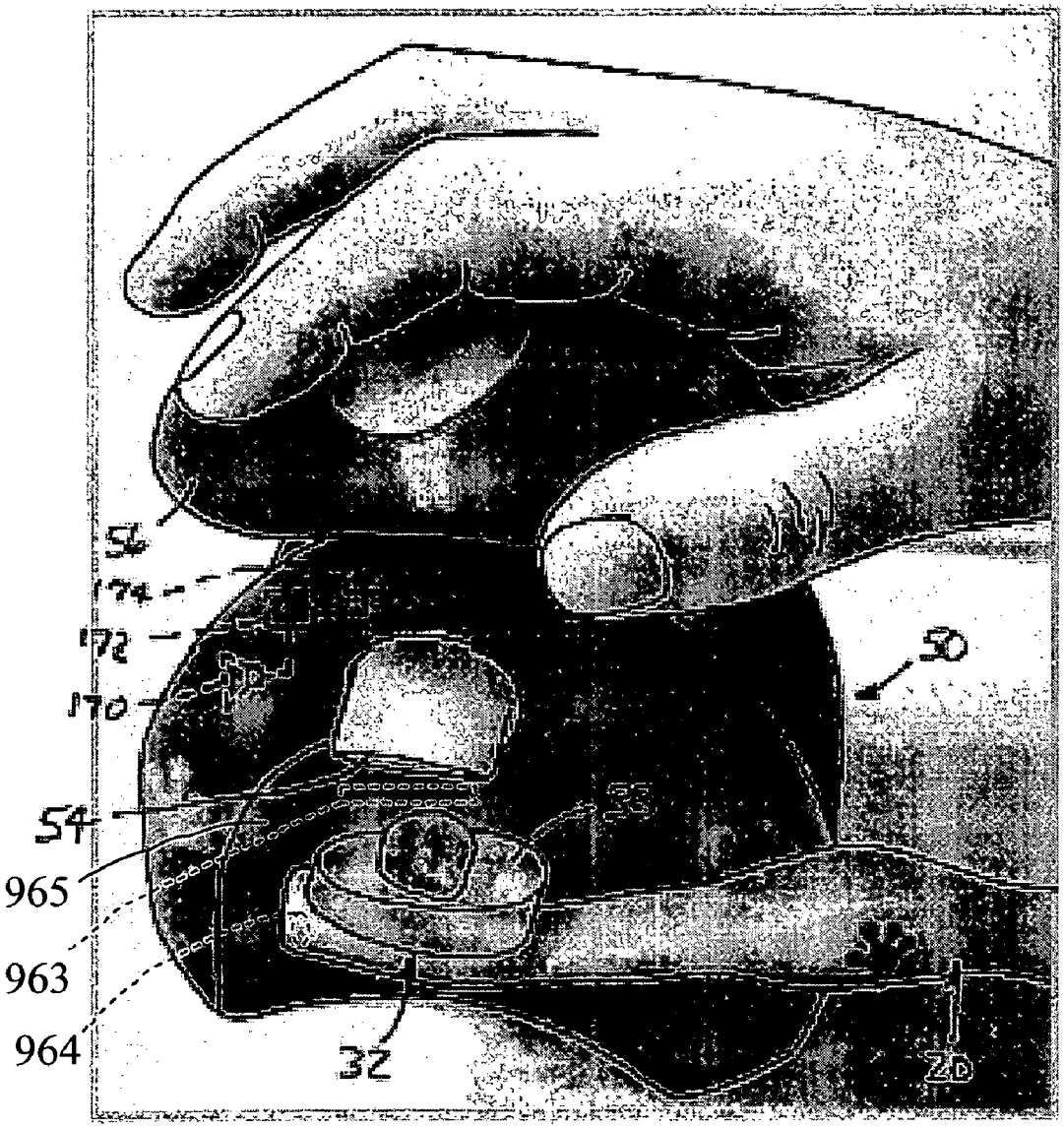
FIG. 5 is a perspective view of the toothpaste dispenser discharging toothpaste onto the toothbrush.

To dispense toothpaste, a user applies a downward actuation force to the activator 56, as illustrated in FIG. 5. The actuation force must be sufficient to overcome the spring bias force to allow the activator to move in a downward direction. The downward direction of the activator 56 also forces the stem 62 and upper piston 76 to move downward. The lower piston 74 resists downward movement to remain in the same position, and therefore the volume of the reservoir is reduced. Simultaneously, the portion 89 of the upper piston 86 disengages the frustoconical portion 82 of the upper wall 78 to open the spout 84. As a result, toothpaste from the reservoir is forced through the spout toward the orifice 54.

When the activator 56 is subsequently released, it returns to the normal position under the force of the spring 58. The stem 62 and upper piston 76 also move in an upward direction until the upper piston 76 again engages the upper wall 78, thereby closing the spout 84. The upward movement of the upper piston 76 draws toothpaste toward the piston 76, which in turn pulls the lower piston 74 in an upward direction. With the lower piston 74 repositioned, the dispensing process may be repeated.

The dispenser may be designed so that the actuation force required to operate the activator 56 is within a child's physical capabilities. Accordingly, the actuation force is less than approximately 50 Newtons, and more preferably less than 25 Newtons.

When used together, the toothbrush 20 and dispenser 50 provide a combination particularly suited for use by children. As illustrated at FIG. 5, the dispenser orifice 54 is positioned at an orifice height X above the support surface 40. The enlarged base 28 supports the brush head 32 at a brush head height Y, which is above the support surface 40 but below the orifice height X, so that the head 32 remains adjacent and below the orifice 54 when the toothbrush 20 is released. The brush head height Y may be approximately 1 to 5 centimeters below the orifice height X to provide sufficient space for the discharged toothpaste.

The passive positioning of the brush head 32 allows the child to focus on operating one oral hygiene article at a time, thereby simplifying the process of loading a toothbrush with toothpaste. The child may grasp the toothbrush 20 and position it on the support surface 40 in close proximity to the dispenser 50. The child may then release the toothbrush 20, so that the head 32 is raised above the support surface 40. If necessary, minor adjustments to the position of the toothbrush 20 may be made to make sure the head 32 is vertically aligned with the orifice 54. Additionally, one skilled in the art would appreciate that a variety of alignment techniques may be used to align head 32 and orifice 54. One such example of an alignment technique includes the use of magnets 963 and 964 which may be located in head 32 and recess 965, respectively. The activator 56 may then be operated to dispense toothpaste onto the head 32.

While a specific type of dispenser has been disclosed, it will be appreciated that various other types of dispensers may be used without departing from the scope of this disclosure. In general, the force that advances toothpaste to the orifice 54 may be supplied manually, electrically, pneumatically, or otherwise. Furthermore, if the toothpaste is provided in a flexible container, the dispenser may squeeze, roll, or otherwise compress the container to force the toothpaste from the container. The dispenser may be freestanding or mounted on a surface such as a wall. The following are specific alternative embodiments of the dispenser.

Figure 6B:
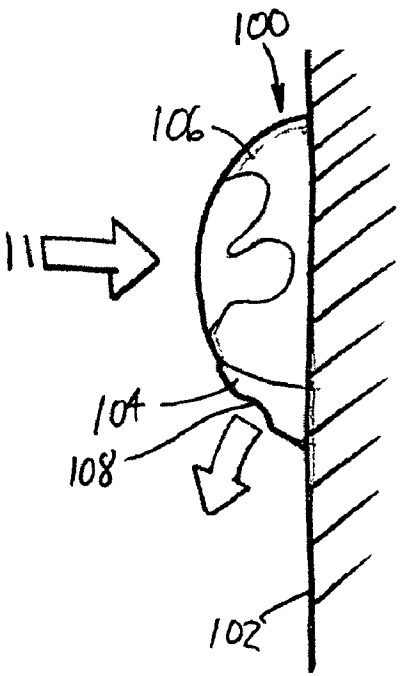
FIGS. 6A and 6B are a perspective view and a side elevation view, respectively, of an alternative embodiment of a toothpaste dispenser for use with a toothbrush.
Figure 6A:
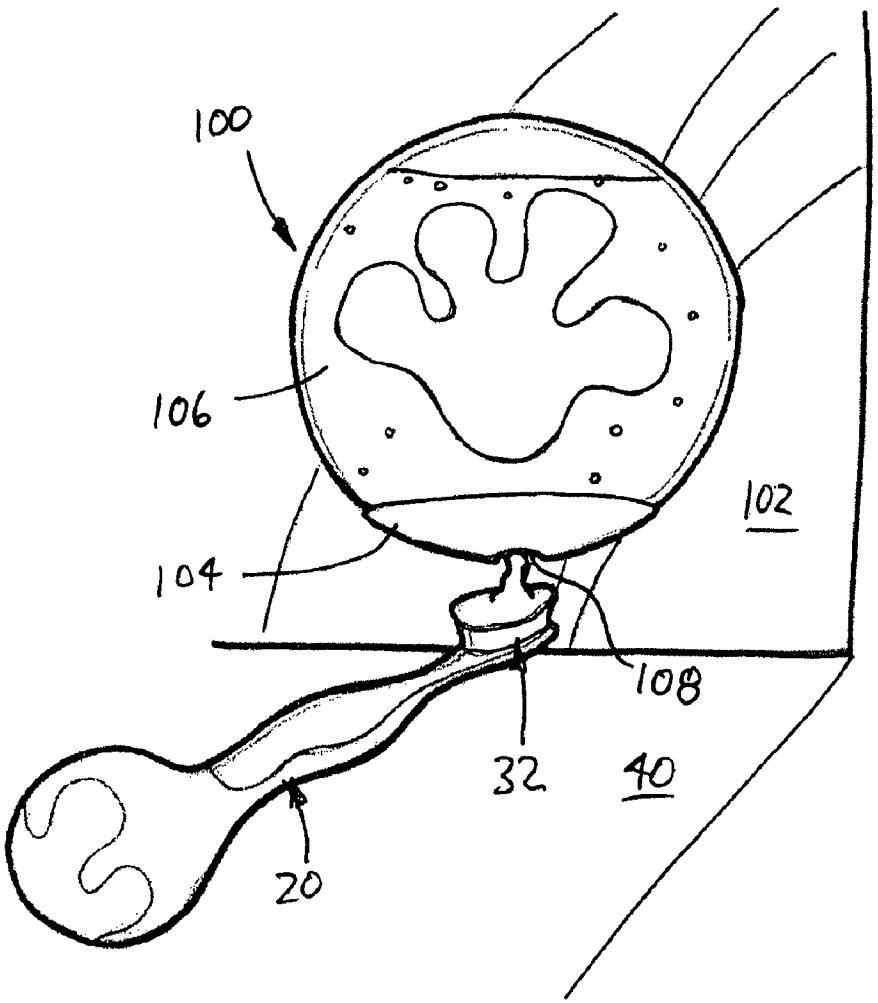

FIGS. 6A and 6B illustrate a dispenser 100 adapted for mounting on a wall 102. The dispenser includes a housing 104 carrying a flexible container 106 of toothpaste. The housing 104 further includes an orifice 108 in fluid communication with an interior of the flexible container 106. The housing 104 may be positioned above the support surface 40 on which the toothbrush 20 lies, so that the brush head 32 is positioned below and proximate to an orifice 106. In operation, a user may press the flexible container 106 inwardly to discharge toothpaste from the orifice 108.

Figures 7A, 7B, 7C:
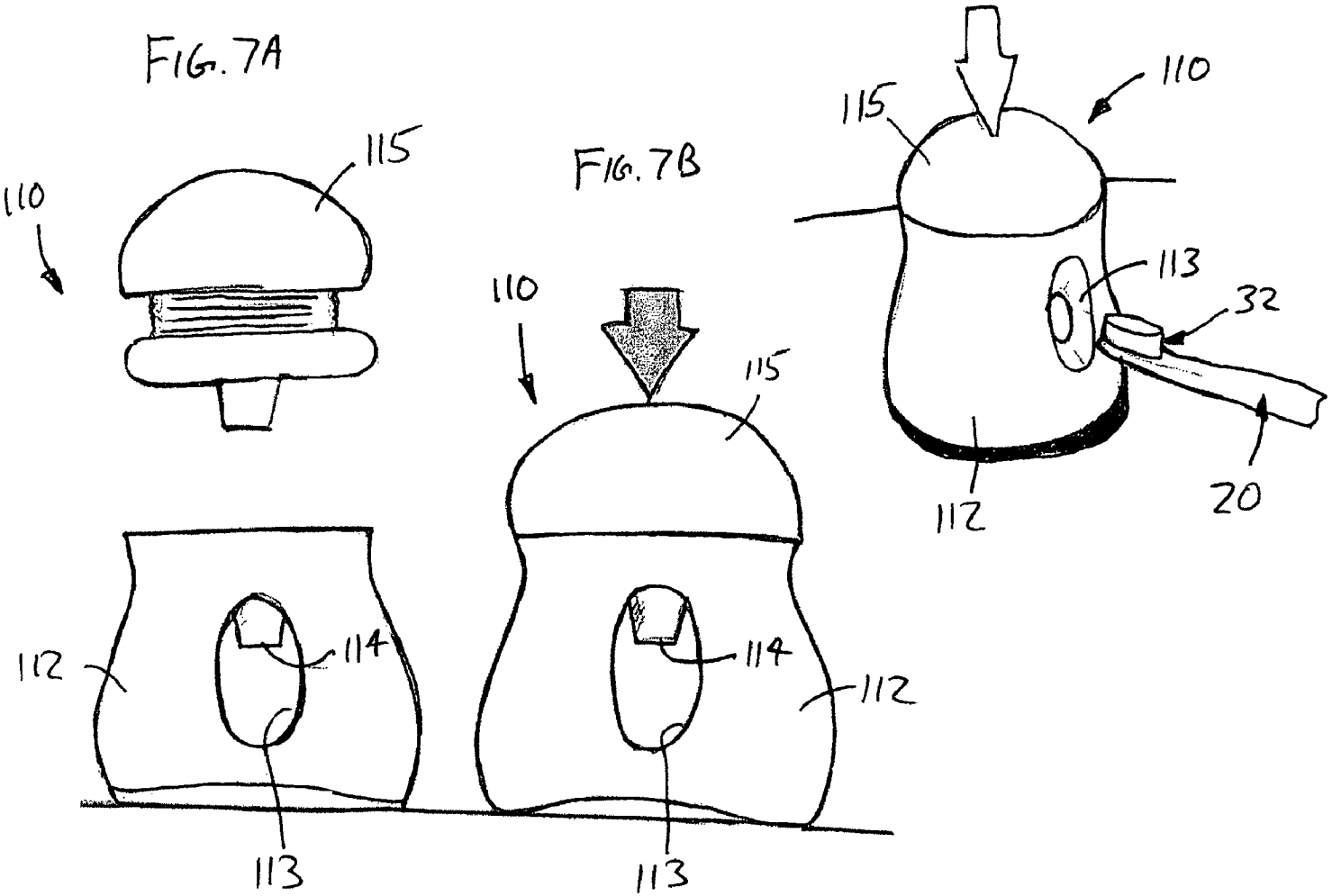
FIGS. 7A-C illustrate a further toothpaste dispenser embodiment for use with a toothbrush.

FIGS. 7A-C illustrate a freestanding dispenser 110 that guides the toothbrush 20 to the appropriate position below an orifice. The dispenser 110 includes a base 112 defining a recess 113 sized to receive the brush head 32 and an orifice 114 positioned above the recess 113. A hand pump/toothpaste cartridge 115 is releasably attached to the base 112 to place the toothpaste cartridge in fluid communication with the orifice 114. In operation, the toothbrush 20 is guided by the recess 113 into position below the orifice 114 and the hand pump is subsequently operated to discharge toothpaste onto the brush head 32.

Figure 8B:
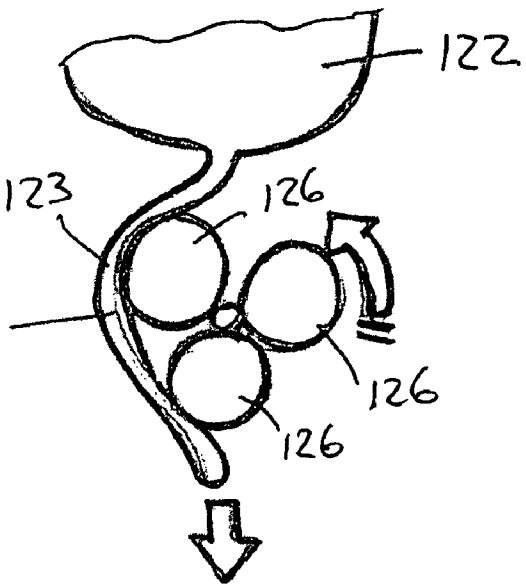
FIGS. 8A and 8B illustrate yet another embodiment of a toothpaste dispenser for use with a toothbrush.
Figure 8A:
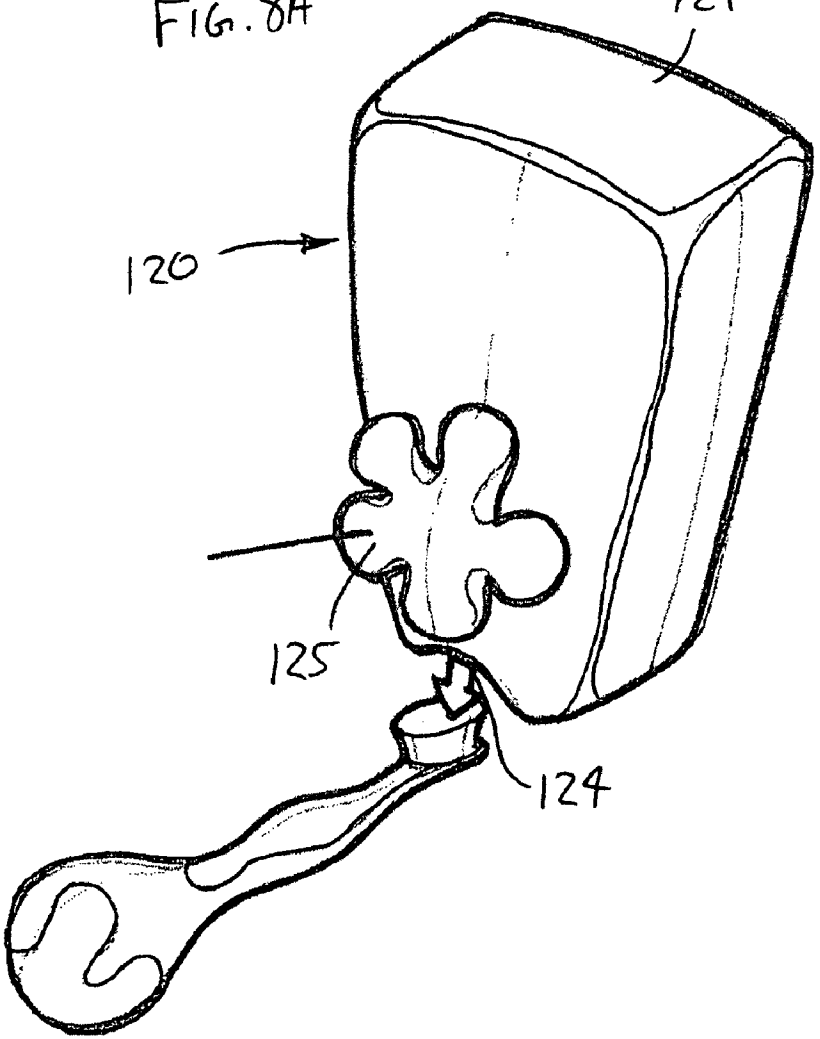

FIGS. 8A and 8B illustrate a wall-mounted dispenser 120 having a peristaltic type pump. The dispenser 120 includes a housing 121 for receiving a container 122 of toothpaste. The container 122 includes an elongate tube 123 extending to a discharge orifice 124 of the housing. A rotatable handle 125 is coupled to rollers 126 positioned to engages and squeeze the tube 123 when rotated. The rollers 126 produce a peristaltic effect that draws toothpaste from the container 122 for discharge from the orifice 124.

Figure 9B:
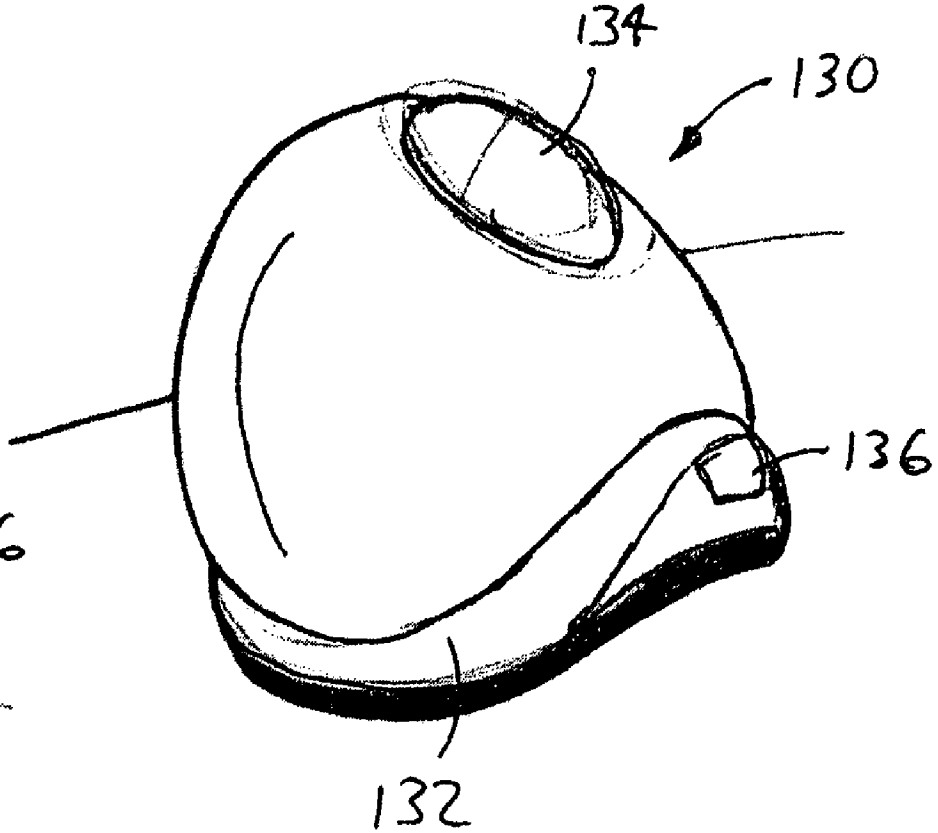
FIGS. 9A and 9B illustrate an additional embodiment of a toothpaste dispenser for use with a toothbrush.
Figure 9A:
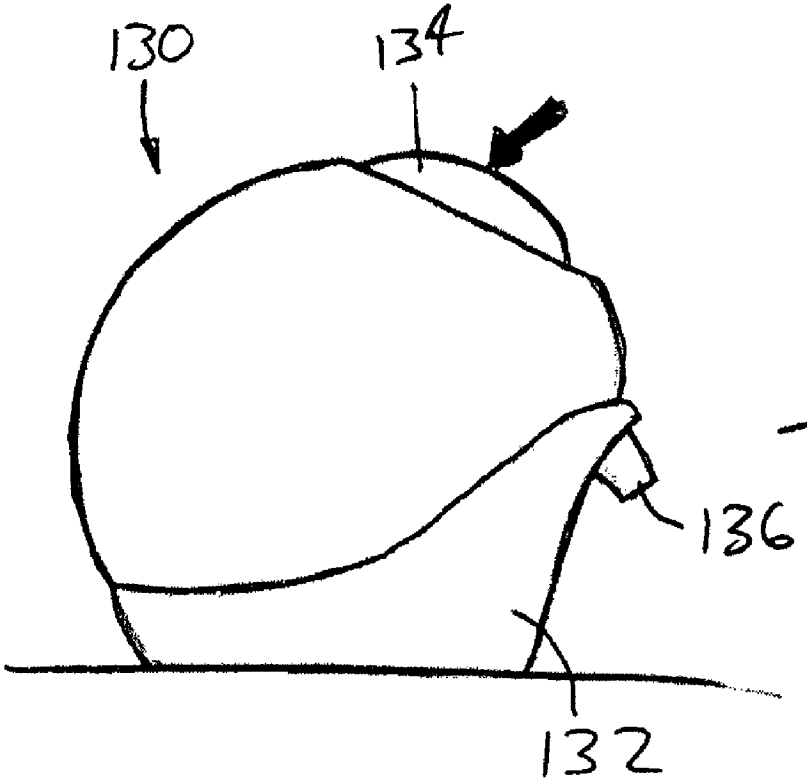

FIGS. 9A and 9B illustrate a freestanding dispenser 130 having a manual pump. The dispenser includes a housing 132 enclosing a flexible container of toothpaste. A depressible button 134 is provided that is movable between normal and depressed positions. The orifice further includes an orifice 136 in fluid communication with the container of toothpaste. In operation, the button 134 is depressed to compress the flexible container, thereby to discharge toothpaste from the orifice 136.

Figures 10A, 10B:
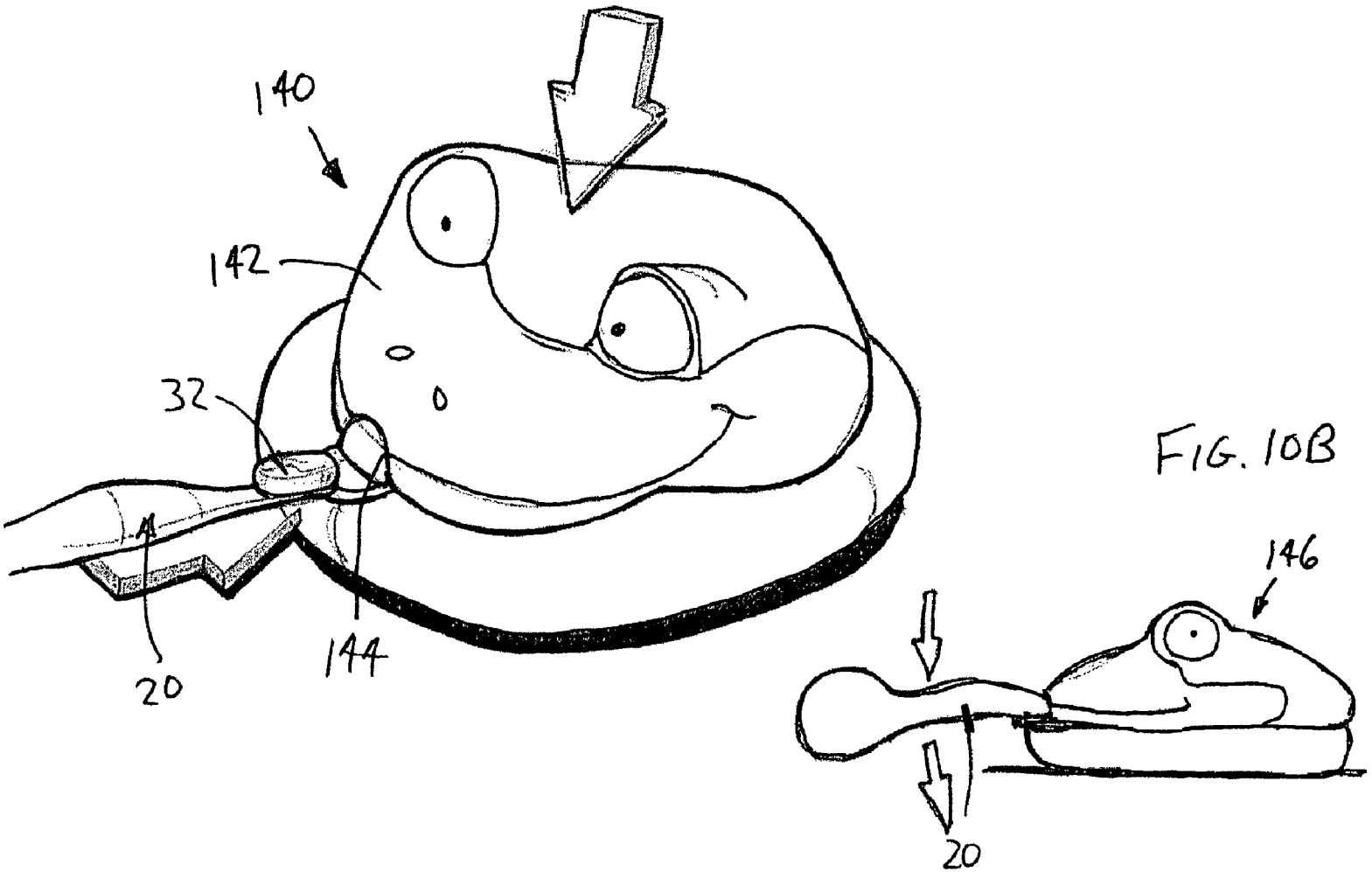
FIGS. 10A and 10B illustrate yet another embodiment of a toothpaste dispenser for use with a toothbrush.

FIGS. 10A and 10B illustrate two related dispenser embodiments resembling a frog head. The dispenser 140 of FIG. 10A includes a flexible pouch 142 defining an orifice 144. When compressed, the flexible pouch 142 forces toothpaste out the orifice 144. In FIG. 10B, a dispenser 146 is actuated by placing the brush head 32 into a recess and cranking the toothbrush in a downward direction to advance toothpaste out an orifice 148.

FIGS. 1A and 1B illustrate a freestanding dispenser 150. The dispenser 150 includes a base 152 defining an orifice 154 and a side receptacle 155 adapted to hold the toothbrush 20. A flexible, ball-shaped container 156 of toothpaste is releasably coupled to the base 152 to place the orifice 154 in fluid communication with an interior of the container 156. A user may directly engage and compress the container 156 to force toothpaste out the orifice 154.

Figure 12A:
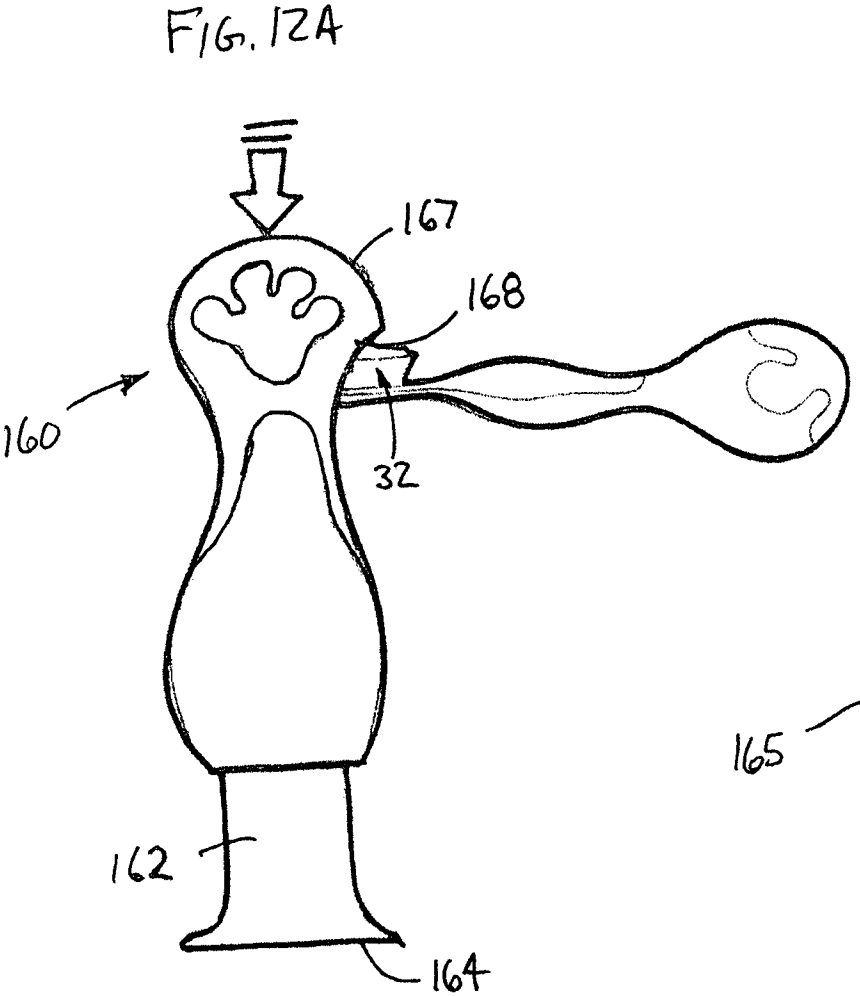
FIGS. 12A and 12B illustrate a further embodiment of a toothpaste dispenser for use with a toothbrush.
Figure 12B:
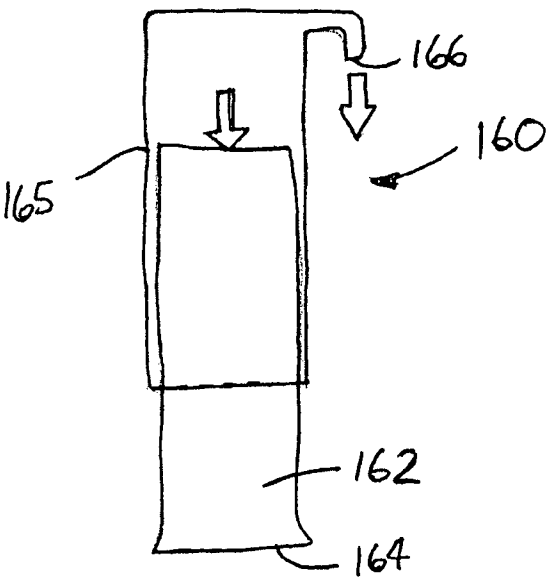

FIGS. 12A and 12B illustrate a freestanding, manual pump style dispenser 160. The dispenser 160 includes a toothpaste cartridge, such as a pump tube 162, having a base 164. As best shown in FIG. 12B, the tube 162 includes a reciprocating upper portion 165 for pressurizing and advancing toothpaste within the tube toward an orifice 166. A pump shroud 167 is disposed over a top portion of the tube 162. The shroud 167 defines a recess 168 sized to receive the brush head 32. Downward force applied to the shroud 166 will compress the upper portion 165 to discharge toothpaste from the orifice 166.

While the foregoing examples illustrate manual compression mechanisms, it will be appreciated that dispensers having automatic or electrical compression mechanisms may be used without departing from the scope of this disclosure. Such electrical compression mechanisms may be similar to the prior art disclosures noted above.

The toothbrushes and dispensers disclosed herein may include images such as character graphics to encourage and motivate a child to brush his or her teeth. The character graphic may provide a source of entertainment and reassurance for the child and a buddy, or friend, who reduces stress and can be related to in a non-competitive fashion during the tooth brush learning period. The character may also provide positive reinforcement and encouragement to the child while the child is learning new skills and behaviors to clean themselves in a non-competitive or threatening manner.

Suitable character graphics can include animals, people, inanimate objects, natural phenomena, cartoon characters or the like, that may or may not be provided with human features such as arms, legs, facial features or the like. It may be desirable for the character graphic to be familiar to the child, such as an identifiable cartoon character. The character graphics should at least be a type that the child can relate to, examples of which could include animals, toys, licensed characters, or the like. Character graphics can be made more personable and friendly to the child by including human-like features, human-like expressions, apparel, abilities, or the like. In one optional embodiment it is desirable for a character to have a distinguishing feature or features, which in a pictograph can help in training, such as a frogs webbed hand. By way of illustration, an animal character graphic can be shown smiling, wearing clothing, playing sports, fishing, driving, playing with toys, or the like. In particular embodiments, the character graphic can desirably be created to project an appearance that could be described as friendly, positive, non-intimidating, silly, independent, inspirational, active, expressive, dauntless and/or persevering.

In one optional embodiment the indicia may optionally include a character graphic which is associated with a line of children's consumer products, especially personal cleansing products and the like. The character may be one of a family, group, team, or the like, each member of which is designed to be associated with, for example, a consumer product, a personal hygiene activity such as brushing teeth, an age group, stage of infant development and the like. Alternatively, all of the characters of a family, group, team, or the like, may be designed to be associated with the entire range of consumer products.

The association by the child of the character with the consumer product, hygiene activity etc., encourages and provides a way for the child to visualize through their imagination the character using the consumer product in the way intended. Furthermore, since this teaching is through the use of the child's imagination, there are none of the negative connotations associated with conventional parental instruction on how to use a consumer product. Instead of the child being subjected to parental nagging to do something the child really doesn't want to do, the child will actively use the consumer product as part of active learning play to interact with their new buddy, or friend, and imitate behavior. The interaction between the child and the character is only limited by the bounds of the child's imagination. The role of the caregiver or parent in then becomes one of actively encouraging imaginative play by the child with the character to use the consumer product correctly, instead of a being perceived by the child as a parent who stops play. Play is actively encouraged and new skills become part of play; "uninterrupted play". Since the use of the product is essentially play, the child is eager to use the article of commerce and learn the skill.

A family or group of character graphics can be used to progress a child through a system of consumer products, especially personal cleansing products and the like. In this embodiment each character of the family or group, would be tailored to appeal to different groups of children. These groups may be based on age, development stages, regions, etc. Alternatively, a single character may be tailored for one particular group consumer products of line of consumer products which are different for children at different ages, development stages, etc. In this case the character may, for example, be of a different age depending on the consumer product and by which group of children the product is intended to be used.

The dispensers and toothbrushes illustrated herein include images depicting a frog character image. For example, the toothbrush 20 and dispenser 50 include frog hand images. Similarly, the dispensers 140, 146 of FIGS. 10A and 10B, respectively, are shaped and include images that give the associated toothpaste containers the appearance of a frog head. While the graphics disclosed herein are related to a frog character graphic, it will be appreciated that other images may be provided, such as different animal character graphics, human character graphics, literary or popular character graphics, designs, or shapes, without departing from the scope of this disclosure.

Alternatively, or in addition to, the appearance, the toothbrush and dispenser may interact in more than one way with the child's senses. For example, actuation of the dispenser may cause initiation of a signal that, for example, causes the appearance of dispenser to change (e.g., a change in color or actuation of a light) or causes origination of a sound. In one alternative embodiment, once initiated, the signal may be maintained for a predetermined time so as to provide reinforcement of a desired behavior. For example, the predetermined time may be the time required for the child to thoroughly brush his or her teeth.

This embodiment is further illustrated by an audio assembly for generating a sound feature during or in response to certain operations, such as actuation of the activator or placement of the toothbrush near the orifice. As schematically illustrated in FIG. 5, the dispenser housing 52 may include a speaker 170 connected to an audio circuit 172. A sensor 174 may be adapted to detect movement of the activator 56 and/or stem 62 and forward a signal to initiate the audio circuit 172, thereby causing speaker to generate the sound feature. For example, the activator 56 may be movable between extended and retracted positions, and the sensor 174 may be adapted to detect when the activator (or stem 62) is in a proximate position, which may generally correspond to the retracted position, and forward a signal to the audio circuit 172 to deliver sound. The audio assembly may be contained entirely within the dispenser to generate a sound feature whenever a certain activity is performed. Alternatively, the elements of the audio assembly may be provided in separate components that must be matched for the sound feature to be generated. For example, the dispenser housing 52 may carry the speaker 170 and sensor 174 while the toothpaste cartridge 70 provides the audio circuit 172 responsive to the sensor 174.

The audio feature may be particularly suited to a child and preferably promotes enthusiasm for using the toothbrush and/or dispenser. For example, the audio feature may provide a positive reinforcement upon successfully operating the dispenser, such as verbal or tonal encouragement. Additionally or alternatively, the audio feature may be a simulated animal sound or cartoon character voice. The audio feature may correspond to a visual feature provided on the toothbrush or dispenser. In the current embodiment, where the toothbrush and dispenser include frog character graphics, the audio feature may be a simulated "ribbit" or other noise typically associated with a frog. The audio feature need not match the frog character graphic, but may instead be provided as a simulated human voice, a series of notes, or other composition. Furthermore, the audio circuit may generate more than one type of sound which may be generated sequentially or randomly upon successful actuations of the activator or other activity, as desired.

All documents cited in the Detailed Description are, in relevant part, incorporated herein by reference; the citation of any document is not to be construed as an admission that it is prior art with respect to the present disclosure.

While particular embodiments of the present disclosure have been illustrated and described, it would be obvious to those skilled in the art that various other changes and modifications can be made without departing from the spirit and scope of the invention. It is therefore intended to cover in the appended claims all such changes and modifications that are within the scope of this disclosure.

We claim:

1. A combination toothbrush and toothpaste dispenser comprises:

a toothpaste dispenser adapted to discharge toothpaste through an orifice, the toothpaste dispenser comprising a housing for storing toothpaste and an activator for selectively advancing toothpaste through the orifice, wherein the orifice is located at an orifice height above a support surface on which the dispenser rests; and a toothbrush including a handle having a proximal end and a distal end, a brush head associated with the distal end defining a toothpaste receiving surface, wherein the handle supports the brush head above the support surface but below the orifice height with the toothpaste receiving surface oriented substantially toward the dispenser orifice, wherein said head of said toothbrush is magnetically aligned with said orifice.

2. The combination of claim 1, in which the toothbrush handle extends at an angle with respect to a plane defined by the support surface so that the distal end is located above the proximal end and the toothpaste receiving surface is located at a brush head height above the support surface.

3. The combination of claim 2, in which the brush head height is approximately one to five centimeters less than the orifice height.

4. The combination of claim 2, in which an enlarged base is coupled to the toothbrush handle proximal end.

5. The combination of claim 4, in which the enlarged base defines a center of gravity offset from a geometric center of the enlarged base away from the handle proximal end, and in which the enlarged base has a mass sufficiently greater than the brush head so that the offset center of gravity automatically lifts the brush head above the support surface.

6. The combination of claim 1, in which the activator has normal and actuated positions, and in which an actuation force required to move the activator between the normal and actuated positions is less than approximately 25 Newtons.

7. The combination of claim 6, in which the actuation force initiates discharge of toothpaste out the orifice.

8. The combination of claim 7, in which the activator applies a manual force to discharge the toothpaste.

9. The combination of claim 7, in which the activator initiates an electrically operated compressing mechanism that applies a force to discharge the toothpaste.

10. The combination of claim 1, in which the toothpaste is disposed in a resilient container.

11. The combination of claim 1, in which the toothpaste is disposed in a rigid container having a movable piston.

12. The combination of claim 1, in which the housing includes a slip-resistant support base.

13. The combination of claim 1, wherein the toothpaste is stored within a cartridge, wherein said cartridge and said housing are adapted to provide lock-and-key functionality.

* * * * *

UNITED STATES PATENT AND TRADEMARK OFFICE

CERTIFICATE OF CORRECTION

PATENT NO. : 7,527,446 B2
APPLICATION NO. : 11/142122
DATED : May 5, 2009
INVENTOR(S) : Alyce Johnson Papa et al.

Figures 11A, 11B:
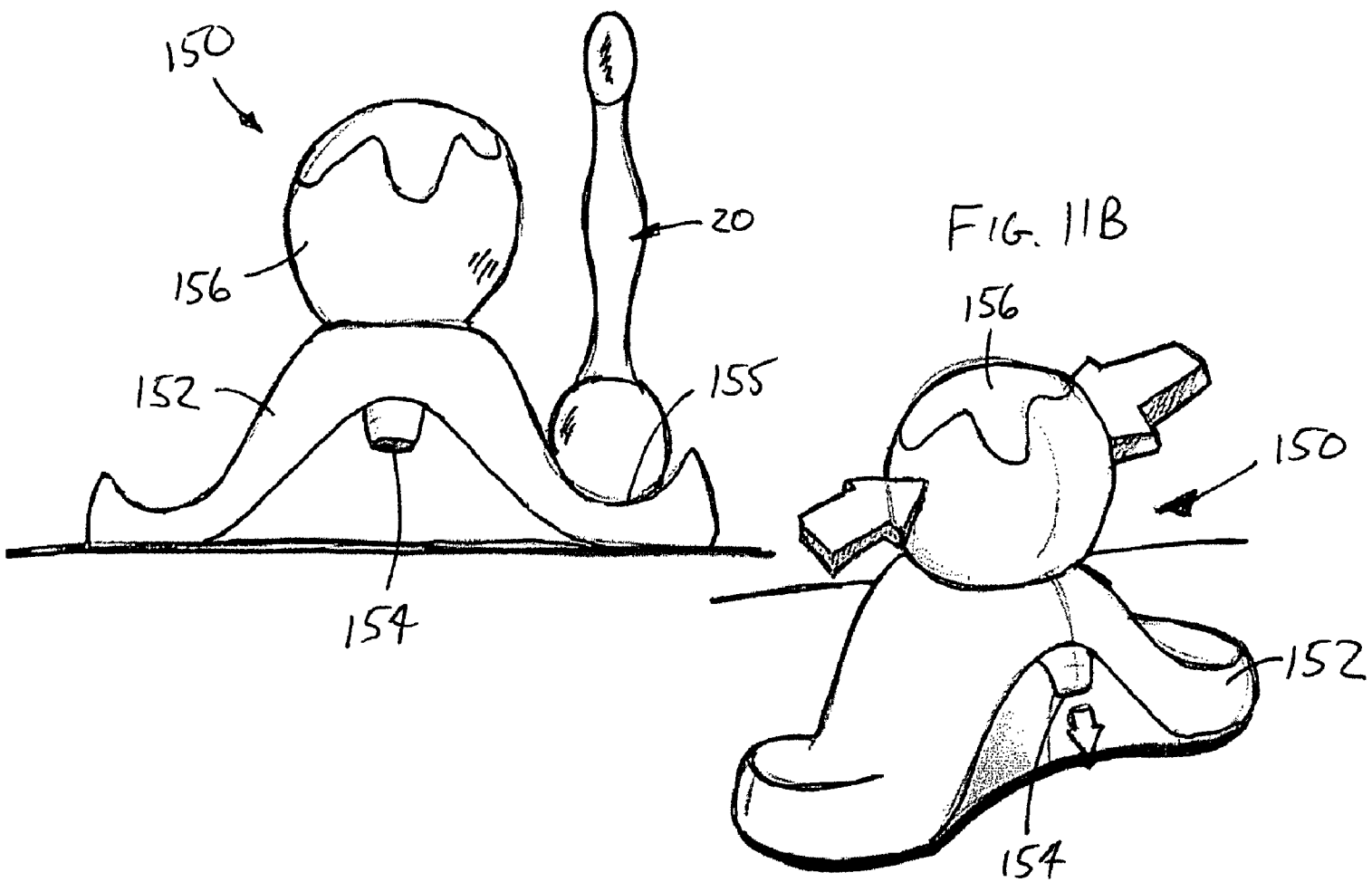
FIGS. 11A and 11B illustrate an additional embodiment of a toothpaste dispenser for use with a toothbrush.

It is certified that error appears in the above-identified patent and that said Letters Patent is hereby corrected as shown below:

Column 5
Line 53, delete "FIGS. 1A and 1B" and insert -- FIGS. 11A and 11B --.

Signed and Sealed this

Twenty-third Day of March, 2010

David J. Kappos

David J. Kappos
*Director of the United States Patent and Trademark Office*